US005101847A

United States Patent [19]

Oribe

[11] Patent Number: 5,101,847

[45] Date of Patent: Apr. 7, 1992

[54] METHOD AND APPARATUS FOR EQUALIZING AIRFLOW VELOCITY

[76] Inventor: Yoshinori Oribe, 1-4, 3 chou-me, Tukamoto-dori, Hyogo-ku, Kobe, Japan

[21] Appl. No.: 597,657

[22] Filed: Oct. 15, 1990

[30] Foreign Application Priority Data

Oct. 31, 1989 [JP] Japan ..... 1-285907

[51] Int. Cl.[5] ..... F24F 13/10

[52] U.S. Cl. ..... 137/1; 137/561 R; 137/561 A; 137/599; 137/861

[58] Field of Search ..... 137/1, 561 R, 561 A, 137/599, 861, 874

[56] References Cited

U.S. PATENT DOCUMENTS

| | | | |
|---|---|---|---|
| 2,126,364 | 8/1938 | Witzel | 137/561 A X |
| 2,547,794 | 4/1951 | Stone | 137/262 X |
| 3,225,788 | 12/1965 | Church et al. | 137/599 |
| 3,279,393 | 10/1966 | Otken . | |
| 3,566,923 | 3/1971 | Avery | 137/599 X |
| 4,519,302 | 5/1985 | Nilsson et al. | 137/876 X |
| 4,528,919 | 7/1985 | Harbolt et al. | 137/561 A X |
| 4,549,567 | 10/1985 | Horton | 137/561 A X |
| 4,679,983 | 7/1987 | Pietryk et al. | 137/876 X |
| 4,741,255 | 3/1988 | Lancaster | 137/561 A X |

FOREIGN PATENT DOCUMENTS

| | | |
|---|---|---|
| 653704 | 11/1937 | Fed. Rep. of Germany . |
| 59-195044 | 11/1984 | Japan . |
| 60-45419 | 3/1985 | Japan . |
| 61-15716 | 1/1986 | Japan . |
| 61-211631 | 9/1986 | Japan . |
| 61-276641 | 12/1986 | Japan . |
| 62-288886 | 12/1987 | Japan . |
| 63-243653 | 10/1988 | Japan . |
| 1-127826 | 5/1989 | Japan . |
| 1131832 | 5/1989 | Japan . |
| 1-142354 | 6/1989 | Japan . |

*Primary Examiner*—John Rivell
*Attorney, Agent, or Firm*—Thomas R. Morrison

[57] ABSTRACT

An air distribution system employs an inner proportioning pipe inside an outer proportioning pipe. Airflow into the proportioning pipes is adjusted by controlling the position of the outer proportioning pipe with respect to the walls of a duct. Proportioning of airflow between the inner and outer proportioning pipes is adjusted by controlling a transverse or an axial relationship of the inner and outer proportioning pipes. Air flowing in the inner proportioning pipe is added to and mixed with air flowing in the outer proportioning pipe in an air balancing chamber. The mixing is performed by rotating vanes. Mixed air from the air balancing chamber is passed through a plurality of discharge openings. The proportioning and mixing provides a predetermined relationship between the airflows at the discharge openings.

14 Claims, 4 Drawing Sheets

METHOD AND APPARATUS FOR EQUALIZING AIRFLOW VELOCITY

BACKGROUND OF THE INVENTION

1. Field of the Invention

This invention relates to a method and an apparatus for equalizing airflow and/or airflow velocity from one or more air supply ducts to a plurality of discharge outlets. Such apparatus is useful in air conditioning and heating systems where equal airflows are desired at a plurality of discharge openings.

2. Description of the Prior Art

Conventionally, dampers or airflow splitters are used in an attempt to equalize the airflow velocity at a plurality of discharge outlets connected to an air duct. These devices produce widely varying airflow at the discharge outlets. For example, where the number of discharge openings is more than 100 in a duct device of drying equipment using passive distribution devices, an airflow velocity of 1 m/sec at each discharge outlet cannot be obtained if the average air duct airflow velocity is for example 10 m/sec. The reason for this is that the pressure loss from a damper or a splitter used to equalize air distribution in the air duct is (0.5 to 5 mm Ag)$\times$100=50 to 500 mm Ag. In addition, a vortex of airflow increasingly occurs as the distance from the air source becomes greater, thus making it more difficult to supply uniform air distribution to the discharge outlets.

OBJECTS AND SUMMARY OF INVENTION

It is an object of the present invention to provide an air proportioning device that intercepts airflow from an air duct supply source and evenly proportions the airflow at a plurality of discharge outlets on the pipe.

It is a further object of the present invention to provide a method of employing a plurality of air proportioning pipes in an air distribution system that supplies a uniform airflow at all of the air proportioning pipe outlets.

The invention provides a pipe for an air conditioning system, an air heating system, or any other type of air distribution system requiring a uniform flow of air from a plurality of discharge outlets. The pipe includes an outer pipe, an inner pipe, flexible elbows that enable centering of the inner pipe within the outer pipe, components comprising an air balancing chamber, and five discharge outlets.

Air velocity is greatest along the center of an air duct. The invention balances the higher air velocity intercepted by an inner pipe situated near the center of the air duct diameter with lower velocity air intercepted by the outer pipe. The air balancing chamber does this by porting inner pipe air through rotating vent apertures that expel a balancing quantity of inner pipe air to mix with the outer pipe air in the air balancing chamber. The airflows in the inner and outer pipes are blended in the air balancing chamber by two rotating vanes. The blended air exits the air balancing chamber through four outer discharge outlets. The four outer discharge outlets combine with an inner discharge outlet to supply five outlets with the same air velocity to the output device. As will be described later, the discharge outlets from a plurality of proportioning pipes can be joined to supply uniform air distribution to one or more sites.

Briefly stated, the present invention provides an air distribution system employing an inner proportioning pipe inside an outer proportioning pipe. Airflow into the proportioning pipes is adjusted by controlling the position of the outer proportioning pipe with respect to the walls of a duct. Proportioning of airflow between the inner and outer proportioning pipes is adjusted by controlling a transverse or an axial relationship of the inner and outer proportioning pipes. Air flowing in the inner proportioning pipe is added to and mixed with air flowing in the outer proportioning pipe in the air balancing chamber. The mixing is performed by rotating vanes. Mixed air from the air balancing chamber is passed through a plurality of discharge openings. The proportioning and mixing provides a predetermined relationship between the airflows at the discharge openings.

According to an embodiment of the invention, there is provided a method for equalizing airflow from a duct to at least two outlets, comprising: intercepting an airflow by a proportioning pipe in a first position in the duct, selecting the first position, with respect to a wall of the duct, to produce a desired airflow, dividing the desired airflow into first and second airflows, the step of dividing including collecting air from a second position within the proportioning pipe, and selecting the second position, with respect to a wall of the proportioning pipe, to produce the dividing.

According to a feature of the invention, there is provided an apparatus for proportioning airflow from a duct to at least first and second discharge outlets, comprising: an outer proportioning pipe, an inner proportioning pipe in the outer proportioning pipe, means for permitting the outer proportioning pipe and the inner proportioning pipe to intercept a portion of the airflow from the duct to produce first and second airflows, respectively, means for proportioning the first and second airflows, an air balancing chamber, means for directing the first and second airflows into the air balancing chamber, means for mixing the first and second airflows in the air balancing chamber to produce a mixed airflow, and means for conducting the mixed airflow to the at least first and second discharge outlets.

According to a further feature of the invention, there is provided an air distribution system for distributing air flowing in a duct to first and second pluralities of outlets, comprising: at least first and second air proportioning pipes, each of the first and second air proportioning pipes including an outer proportioning pipe and an inner proportioning pipe, means for entering airflow from the duct into the first and second air proportioning pipes, means in each of the air proportioning pipes for proportioning an airflow between the outer proportioning pipe and the inner proportioning pipe, a first air balancing chamber, means for admitting airflows from the inner proportioning pipe and the outer proportioning pipe of the first air proportioning pipe into the first air balancing chamber, means for mixing air in the first air balancing chamber, means for delivering air from the first air balancing chamber to the first plurality of outlets, a second air balancing chamber, means for admitting airflows from the inner proportioning pipe and the outer proportioning pipe of the second air proportioning pipe into the second air balancing chamber, means for mixing air in the second air balancing chamber, means for delivering air from the second air balancing chamber to the second plurality of outlets.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
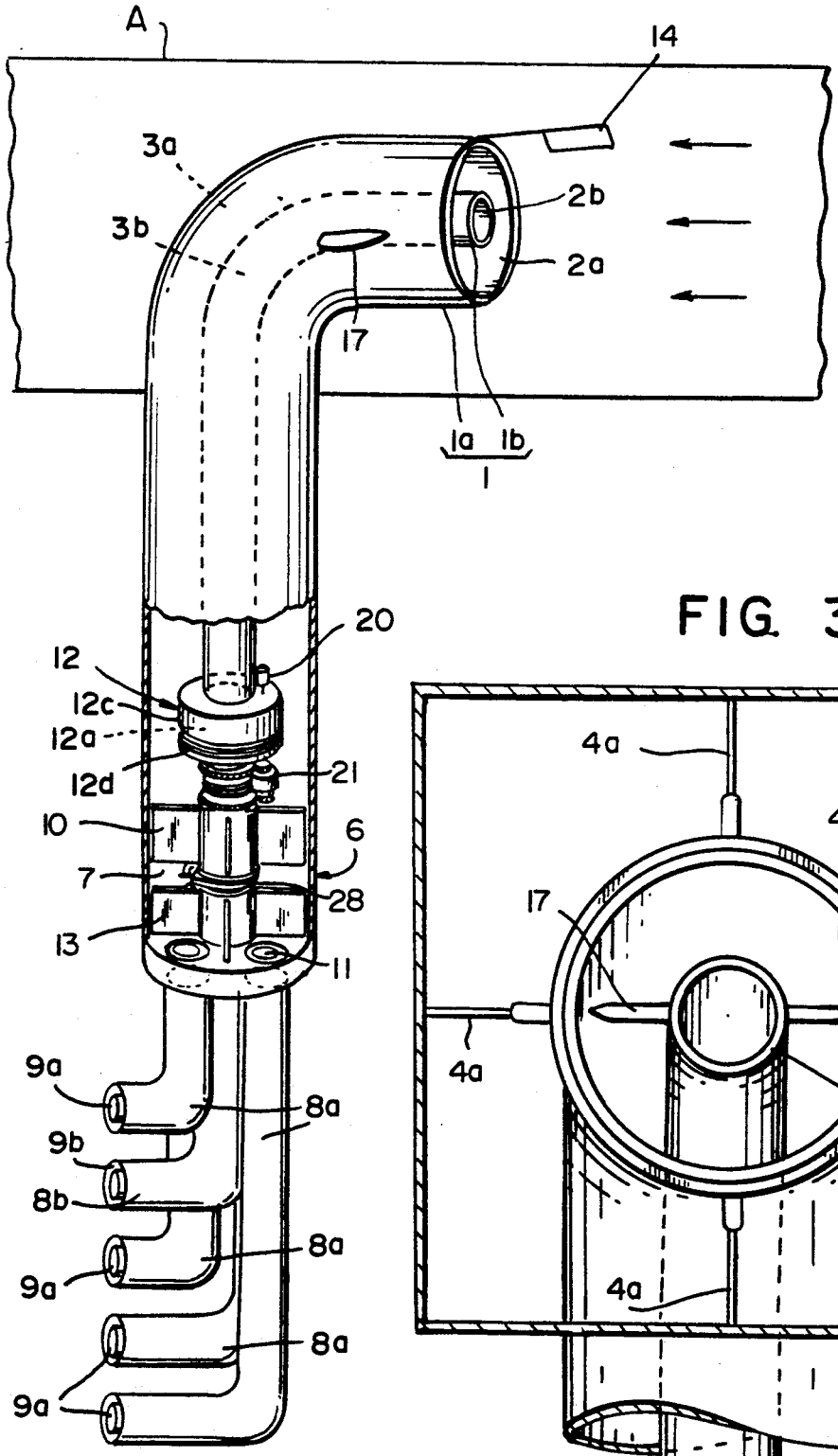
FIG. 1 is a cross section showing an embodiment of the proportioning pipe disposed in an air duct.

Referring to FIG. 1, a proportioning pipe 1, disposed in an air duct A, includes an inner proportioning pipe 1*b* inside an outer proportioning pipe 1*a*. The diameter and wall thickness of each pipe may vary depending on the application. An air guide or diverter 14 is mounted on the peripheral edge of the outer pipe inlet 1*a* to divert an adjustable amount of airflow into proportioning pipe 1.

Proportioning pipe 1 may be supported freely with respect to air duct A so that it may ride up or down therein. At least one positioning vane 17 is mounted on a outer surface of proportioning pipe 1*a*. Changing the inclination angle of the positioning vane 17 in relation to the airflow in air duct A causes proportioning pipe 1 to move up or down. As is well known, wall friction causes air flowing adjacent the walls of air duct A to have a lower velocity than air along the center of air duct A. Thus, the velocity of air at the open end of proportioning pipe 1 changes as proportioning pipe 1 moves closer to, and further away from, the walls of air duct A. A conventional air velocity sensor (not shown) may be positioned at a strategic location on or near proportioning pipe 1 to sense the airflow. Positioning vane 17 may then be adjusted in response to the output of the air velocity sensor.

The air velocity sensor, discussed in the preceding paragraph, may be of any conventional type including, for example, a sight-gauge anemometer, a propeller anemometer, a hot-wire anemometer, or a buffet-frequency anemometer. The output of the air velocity sensor may be a meter reading which may be used as a guide for manual adjustment of positioning vane 17, or it may be an electrical signal used by a control system (not shown) for automatically driving an electric motor (not shown) to adjust positioning vane 17 until a commanded air velocity is sensed.

Figure 3:
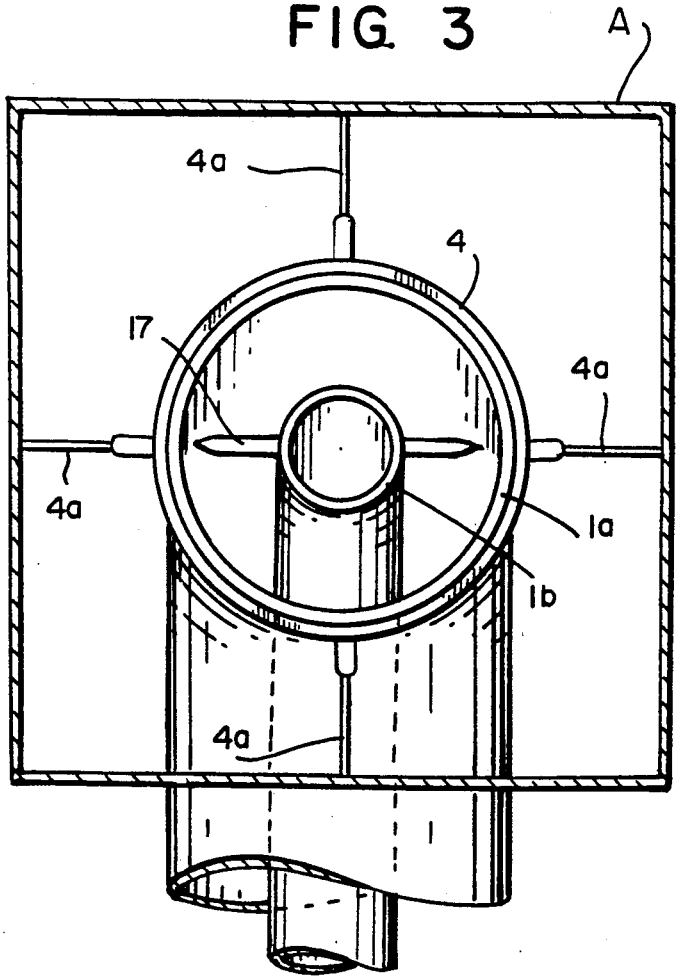
FIG. 3 is an end view of the proportioning pipe inside the air duct.
Figure 2:
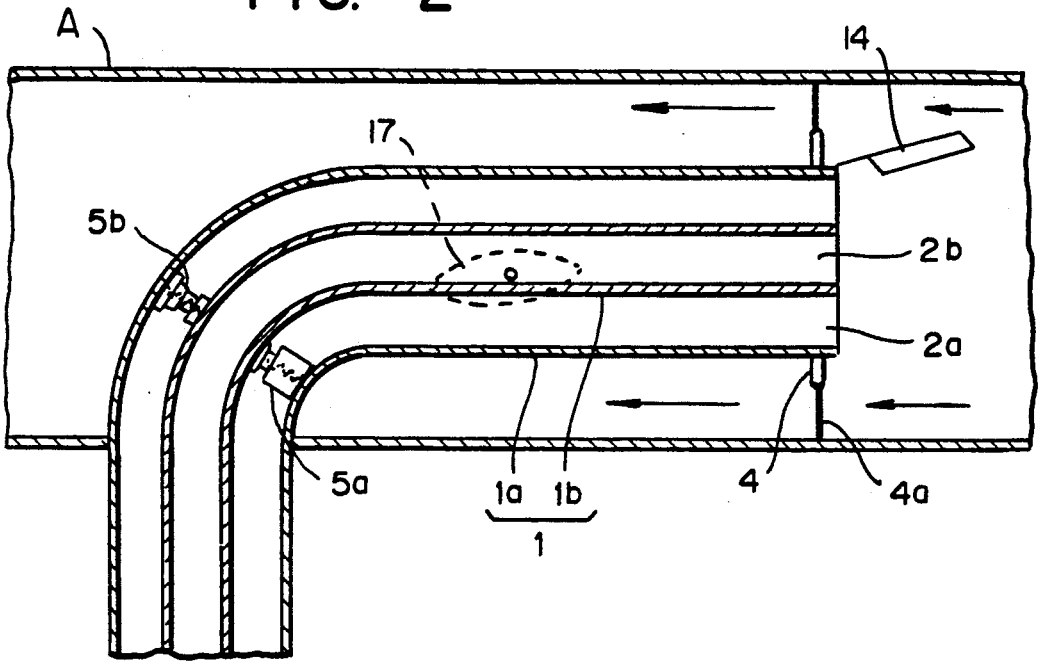
FIG. 2 is a cross section of the proportioning pipe showing centering supports maintaining central position of the inner pipe within the outer pipe.
Figure 7:
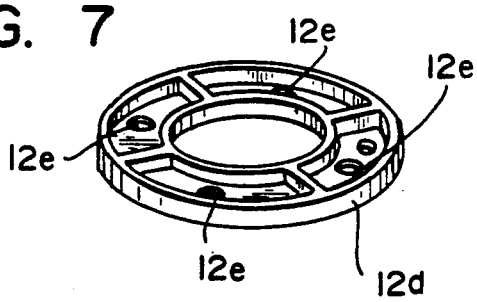
FIG. 7 is a perspective view of the vent plate at the bottom of the airflow regulator.

Referring to FIGS. 2 and 3, the inlet end of proportioning pipe 1 is constrained in the airflow path of air duct A by a guide ring 4. A spider 4*a*, whose outer ends are affixed to air duct A, supports guide ring 4.

An inner positioning support 5*a* and an outer positioning jack 5*b* are disposed at an elbow of inner and outer proportioning pipes 1*a* and 1*b*. Inner positioning support 5*a* contains a resilient element such as, for example, a coil spring. Outer positioning jack 5*b* includes means such as, for example, a nut and screw, effective to permit adjustment of its length. As the length of outer positioning jack 5*b* is changed, inner positioning support 5*a* changes its length in the opposite sense to cause inner proportioning pipe 1*b* to move toward or away from outer proportioning pipe 1*a*. Also, since a line of action joining inner positioning support 5*a* and outer positioning jack 5*b* is inclined at an angle to the intake end of proportioning pipe 1, as they are adjusted, the intake end of inner proportioning pipe 1*b* is moved axially with respect to the intake end of outer proportioning pipe 1*a*.

As explained above, air velocity near a wall of a duct is lower than further away therefrom. Thus, the transverse movement of inner proportioning pipe 1*b* adjusts the proportion of air entering inner and outer proportioning pipes 1*b* and 1*a*. In addition, a greater amount of air enters inner proportioning pipe 1*b* when its intake end extends beyond the intake end of outer proportioning pipe 1*a*. Thus, the two motions of inner proportioning pipe 1*b*, transverse and axial, both tend to adjust the proportioning of airflow between inner and outer proportioning pipes 1*b* and 1*a*.

It would be evident to one skilled in the art that the positions of inner positioning support 5*a* and outer positioning jack 5*b* may be transposed without changing the operation of the device. In addition, control of the transverse and axial motions of inner proportioning pipe 1*b* may be achieved by separate means (not shown). For example, instead of one pair of support/jack devices having an inclined line of action, two pairs of such devices, one pair acting vertically, and the other pair acting horizontally, may be provided. It is believed that illustration of this arrangement is not necessary to enable one skilled in the art to make and use the product of the invention.

As described in the preceding, the airflow intercepted by outer proportioning pipe 1*a* is adjusted by controlling its transverse position within air duct A. Also, the proportion of air flowing in inner and outer proportioning pipes 1*b* and 1*a* is adjusted by controlling at least one of the transverse and axial positions of inner proportioning pipe 1*b* with respect to outer proportioning pipe 1*a*.

Referring to FIGS. 4, 5, 6, 7, 8, 9 and 10, an airflow regulator 12, surrounding a lower end of inner proportioning pipe 1*b* includes a butterfly valve 27, which pivots on a vertical axis to adjust further the proportion of air flowing in inner and outer proportioning pipes 1*b* and 1*a*.

A motor 20 rotates a drive pinion 23*a*, which is meshed with an idler ring gear 23*b* fixed to the outer wall of a rotary cylinder 12*g*. The rotary cylinder 12*g* rotates around the inner proportioning pipe 1*b*. Also fixed to, and rotated by the rotary cylinder 12g, is a vent disk 12d and a ring-type gearbox drive gear 23c. Gearbox drive gear 23c meshes with gearbox drive pinion 21a, which rotates the gear assembly in gearbox 21. Air dispersion apertures 24 within the airflow regulator enclosure 12c are disposed above the rotating vent disk 12d. Air from inner the proportioning pipe 1b is expelled through the air dispersion apertures 24 downward through vent holes 12e near the bottom of the airflow regulator enclosure 12c and through vent apertures 12h of the rotating vent disk 12d. Below the vent disk 12d, the expelled air from the inner proportioning pipe 1b mixes with air that has reached this region between the inner and outer proportioning pipes 1b and 1a.

Figure 8:
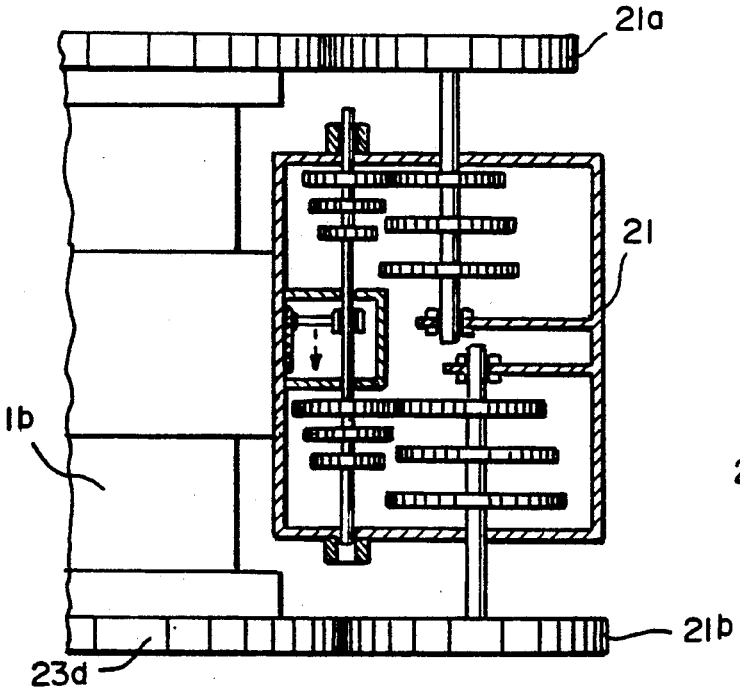
FIG. 8 is a cross section of the gear-box assembly used to drive the upper rotating vane.
Figure 9:
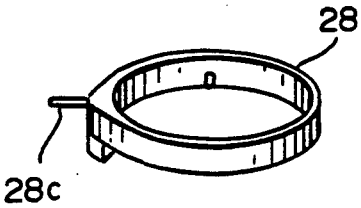
FIG. 9 is a perspective view of the lower rotating vane vertical oscillating cam.
Figure 4:
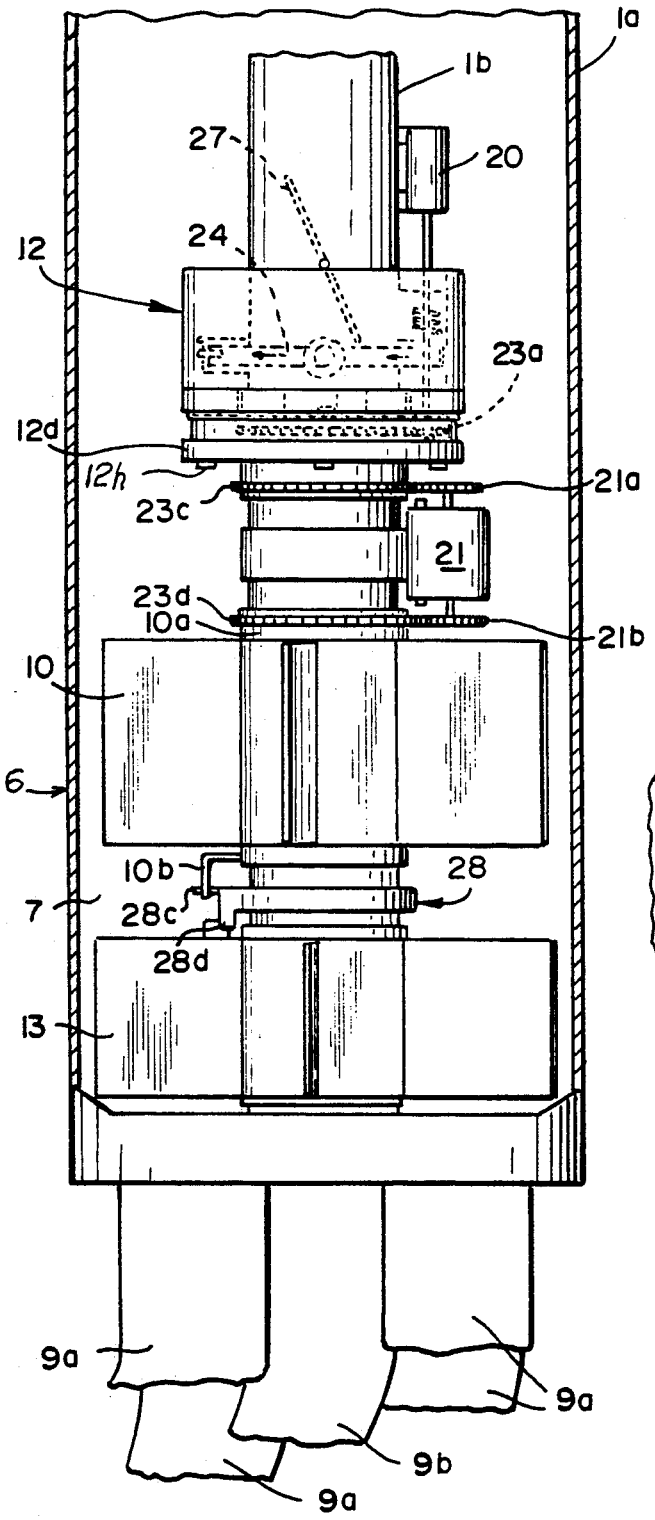
FIG. 4 is a detailed cross section of the components in the air balancing chamber of the proportioning pipe.
Figure 5:
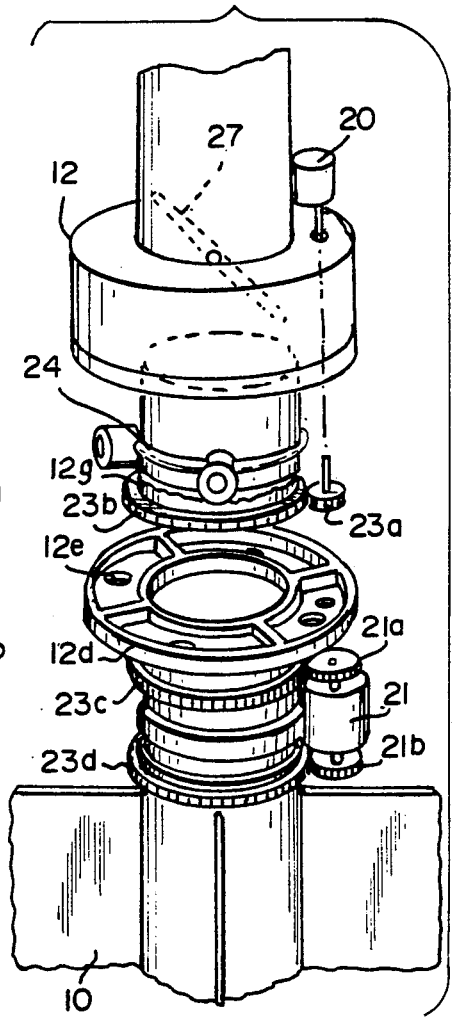
FIG. 5 is an exploded view of the blending chamber of the proportioning pipe.
Figure 6:
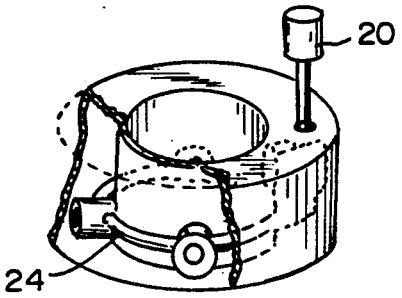
FIG. 6 is a cross section of the airflow regulator assembly showing the air dispersion apertures.
Figure 10A:
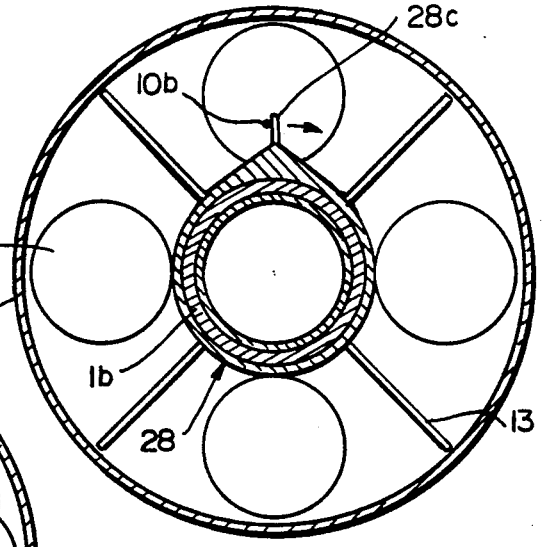
FIG. 10*a* is a top view of the discharge pipe orifices showing the actuator on the upper vane and the extension on the vertical oscillating cam of the lower rotating vane.
Figure 10B:
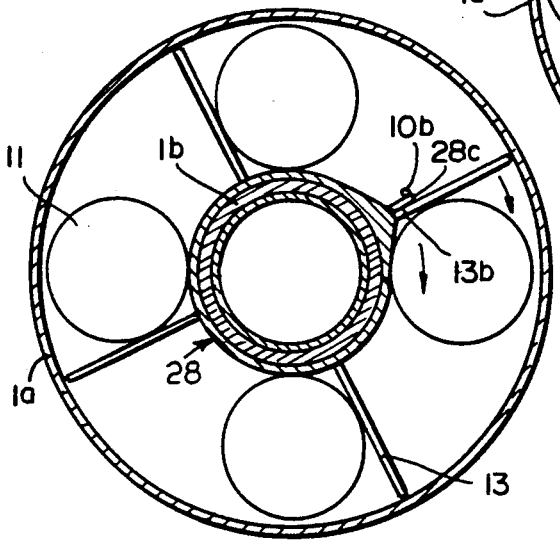
FIG. 10*b* is a top view of the discharge pipe orifices showing the actuator on the upper vane engaging the extension on the vertical oscillating cam.

Gearbox drive gear 23c drives a gearbox drive pinion 21a of a gear box 21. An output pinion 21b of gear box 21 meshes with a gear 23d affixed to an upper rotating vane assembly 10. As can be seen in FIG. 8, gearbox 21 can be set to any one of three gear ratios to rotate the upper rotating vane assembly 10 at a selected one of three rotational speeds. The selection of a gear ratio may be performed manually, or it may be performed in response to a computer command. The computer command may be produced in response to a signal from an airflow sensor (not shown). For example, as the computer detects an increase in airflow velocity, it correspondingly selects a gear ratio that increases the speed of the upper rotating vane assembly 10. A nominal gear reduction ratio of about 10:1 may be used.

As upper rotating vane assembly 10 is rotated, it tends to mix and agitate the air from inner and outer proportioning pipes 1b and 1a, whereby generally uniform downward air velocity is produced at all circumferential locations.

Referring to FIGS. 4, 5, 9 and 10a and 10b, an L-shaped lower vane actuator 10b on the upper rotating vane assembly 10 engages an extension 28c on a lower vane drive cam 28, causing a lower rotating vane assembly 13 to rotate. Air from inner proportioning pipe 1b and outer proportioning pipe 1a is blended in a balancing air space 7 of an air balancing chamber 6 and discharged through four outer airflow orifices 11 and a central orifice 11 situated below the lower rotating vane assembly 13. The four outer orifices 11 feed air to respective ones of four outlet ducts 8a. Central orifice 11 feeds air to a central outlet duct 8b. Ducts 8a and 8b terminate in outlets 9a and 9b, respectively.

The combined action of the upper rotating vane assembly 10 and lower rotating vane assembly 13 equalizes the differences between the airflow in inner and outer proportioning pipes 1b and 1a, and also equalizes airflow downward velocities about the cross section so that all of outlets 9a and 9b deliver the same airflow velocity.

Figure 11:
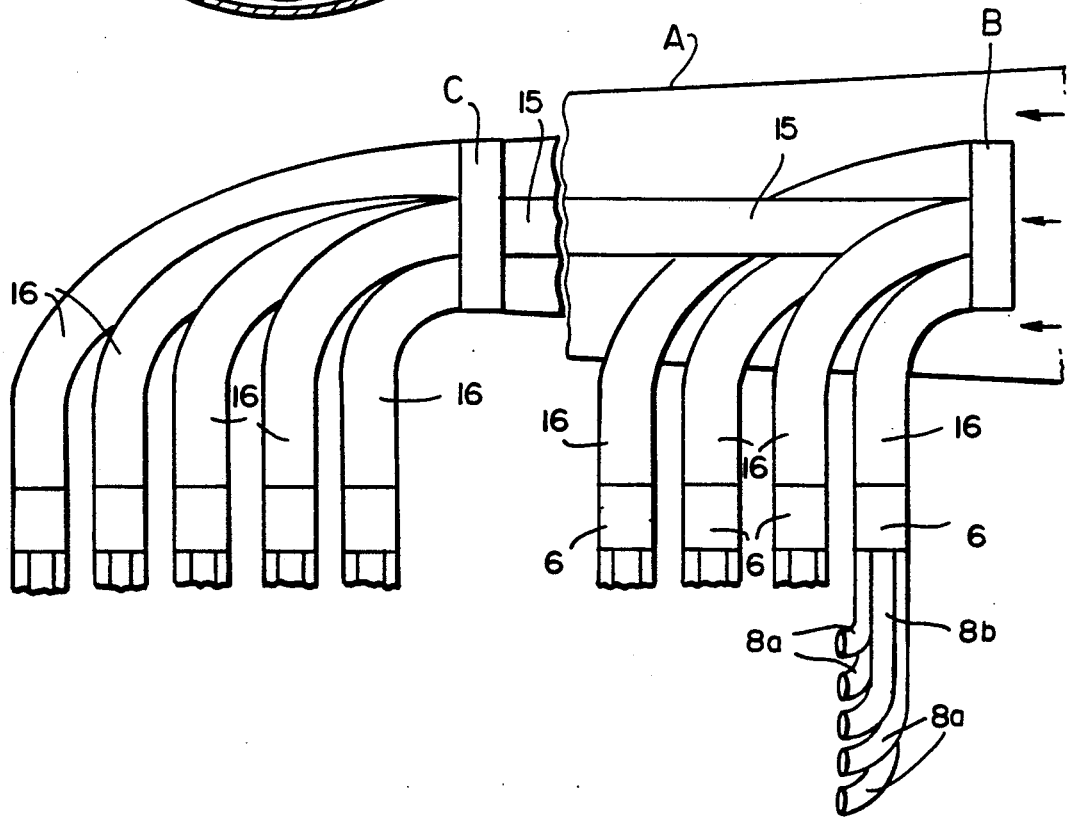
FIG. 11 shows an air distribution system wherein a plurality of proportioning pipes are employed to proportion all of the air in a duct to a large number of outlet orifices.

Referring to FIG. 11, an embodiment of a method and the apparatus for an air distribution system using the current invention is shown. In the embodiment, four of the current invention proportioning pipes are ganged together with an air inlet B inside air duct A. Air duct A is tapered to compensate for decreased air velocity caused by the air intercept apparatus at air inlet B. Air inlet B has a main pipe 15 at its center and a plurality of proportioning pipes 1 extending outside the air duct A. Main pipe 15 provides partial input to air inlet C where another array of proportioning pipes are ganged together. This embodiment can be used for various kinds of air distribution systems requiring a large number of discharge outlets. For example, if five air inlets (B–F) are installed in air duct A and there are four proportioning pipes 1 at each air inlet (B–E), and five proportioning pipes 1 in the last air inlet F, because the last air inlet can use main pipe 15 as input to a proportioning pipe 1, a total of 105 discharge outlets of uniform air velocity can be provided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for equalizing airflow from a duct to at least two outlets, comprising:

intercepting an airflow by a proportioning pipe in a first position in said duct;

selecting said first position, with respect to a wall of said duct, to produce a desired airflow;

dividing said desired airflow into first and second airflows;

the step of dividing, including collecting air from a second position within said proportioning pipe; and selecting said second position, with respect to a wall of said proportioning pipe, to produce said dividing.

2. A method as claimed in claim 1, wherein said second position includes at least one of a transverse position and an axial position.

3. A method according to claim 1, further comprising:

the step of dividing, including intercepting a portion of said airflow in an inner proportioning pipe located inside said proportioning pipe; and mixing said first and second airflows prior to emitting them from said at least two outlets.

4. A method according to claim 3, wherein the step of mixing includes:

emitting said first airflow through a rotating device into said second airflow; and mixing said first and second airflows.

5. An apparatus for proportioning airflow from a duct to at least first and second discharge outlets, comprising:

an outer proportioning pipe;

an inner proportioning pipe in said outer proportioning pipe;

means for permitting said outer proportioning pipe and said inner proportioning pipe to intercept a portion of said airflow from said duct to produce first and second airflows, respectively;

means for proportioning said first and second airflows;

an air balancing chamber;

means for directing said first and second airflows into said air balancing chamber;

means for mixing said first and second airflows in said air balancing chamber to produce a mixed airflow; and means for conducting said mixed airflow to said at least first and second discharge outlets.

6. Apparatus according to claim 5, wherein said means for proportioning includes:

means for permitting said outer proportioning pipe to be moved transversely with respect to said duct; and means for permitting said inner proportioning pipe to be moved with respect to said outer proportioning pipe in at least one of a transverse and an axial direction.

7. Apparatus according to claim 5, wherein said means for proportioning includes a butterfly valve in said inner proportioning pipe.

8. Apparatus according to claim 5, wherein said means for mixing includes:

a plurality of apertures between an end of said inner proportioning pipe and said air balancing chamber;

first means for rotating said plurality of apertures, whereby second airflow is added to said air balancing chamber;

means for admitting first airflow to said air balancing chamber;

a vane assembly in said air balancing chamber; and second means for rotating said vane assembly to mix said first and second airflows.

9. Apparatus according to claim 8, wherein said first means for rotating includes a motor.

10. Apparatus according to claim 9, wherein said second means for rotating includes:

a gearbox driven by said motor; and said gearbox including reduction gearing.

11. Apparatus according to claim 10, wherein said gearbox includes at least two gear ratios.

12. An air distribution system for distributing air flowing in a duct to first and second pluralities of outlets, comprising:

at least first and second air proportioning pipes;

each of said first and second air proportioning pipes including an outer proportioning pipe and an inner proportioning pipe;

means for entering airflow from said duct into said first and second air proportioning pipes;

means in each of said air proportioning pipes for proportioning an airflow between said outer proportioning pipe and said inner proportioning pipe;

a first air balancing chamber;

means for admitting airflows from said inner proportioning pipe and said outer proportioning pipe of said first air proportioning pipe into said first air balancing chamber;

means for mixing air in said first air balancing chamber;

means for delivering air from said first air balancing chamber to said first plurality of outlets;

a second air balancing chamber;

means for admitting airflows from said inner proportioning pipe and said outer proportioning pipe of said second air proportioning pipe into said second air balancing chamber;

means for mixing air in said second air balancing chamber;

means for delivering air from said second air balancing chamber to said second plurality of outlets.

13. Apparatus according to claim 12, wherein said airflow entered into said at least first and second air proportioning pipes includes less than all of said air flowing in said duct.

14. Apparatus according to claim 12, wherein said airflow entered into said at least first and second air proportioning pipes includes all of said air flowing in said duct.

* * * * *